US008613166B2

(12) United States Patent
Smith

(10) Patent No.: US 8,613,166 B2
(45) Date of Patent: Dec. 24, 2013

(54) COLLAPSIBLE TEMPORARY HOUSING SYSTEM STACKABLE UPON OTHERS FOR TRANSPORT

(75) Inventor: David S. Smith, Debary, FL (US)

(73) Assignee: The David S. Smith Irrevocable Trust, Debary, FL (US)

( * ) Notice: Subject to any disclaimer, the term of this patent is extended or adjusted under 35 U.S.C. 154(b) by 0 days.

(21) Appl. No.: 12/779,455

(22) Filed: May 13, 2010

(65) Prior Publication Data

US 2010/0287847 A1 Nov. 18, 2010

Related U.S. Application Data

(60) Provisional application No. 61/177,727, filed on May 13, 2009.

(51) Int. Cl.
*E04B 1/346* (2006.01)

(52) U.S. Cl.
USPC ..... 52/66; 52/71; 52/79.5; 52/122.1; 52/69

(58) Field of Classification Search
USPC ..... 52/66, 69, 71, 79.5, 79.9, 309.8, 582.1, 52/584.1, 122.1, 125.1, 220.1, 220.2; 410/106–113; 294/215
See application file for complete search history.

(56) References Cited

U.S. PATENT DOCUMENTS 2,701,038 A * 2/1955 Mooney ..... 52/69
2,883,713 A 4/1959 Zug
2,894,290 A * 7/1959 Lundstedt ..... 52/71
RE25,827 E * 8/1965 Bigelow ..... 206/386
3,280,796 A 10/1966 Hatcher
3,341,987 A 9/1967 Johansson
3,983,665 A 10/1976 Burton
4,156,998 A * 6/1979 McClure ..... 52/309.5
4,295,446 A 10/1981 Voss
4,989,379 A 2/1991 Suzuki
5,107,639 A 4/1992 Morin et al.
5,381,633 A 1/1995 Hendrich
5,444,897 A * 8/1995 Gross ..... 24/265 CD
5,493,818 A * 2/1996 Wilson ..... 52/71
5,596,844 A 1/1997 Kalinowski
5,611,449 A * 3/1997 Pedersen ..... 220/6
5,765,316 A 6/1998 Kavarsky
6,039,500 A * 3/2000 Kwon ..... 403/78
6,119,427 A * 9/2000 Wyman et al. ..... 52/584.1
6,253,498 B1 7/2001 Fanucci
6,601,598 B2 8/2003 Clee et al.

(Continued)

*Primary Examiner* — Brian Glessner
*Assistant Examiner* — Adam Barlow
(74) *Attorney, Agent, or Firm* — Terry M. Sanks, Esq.; Beusse Wolter Sanks Mora & Maire, P.A.

(57) ABSTRACT

A collapsible temporary housing system including a base, four walls being connected along each respective edge extending between at least two of the four corners, the walls being pivotally connected along the edges of the base so that when the walls are pivoted into a collapsible configuration each wall is laid upon a previously collapsed wall creating a nearly horizontal surface extending across a top surface area of the base, and a flat roof, the flat roof being detached from the four walls while the four walls are pivoted into an erected position, secured to the walls once the walls are erected, and set upon the nearly horizontal surface when the walls are pivoted into a collapsible configuration, wherein a plurality of other temporary housing systems may be stacked where a lean of the stacked housing systems which could result in the stacked housing systems falling over is not present.

18 Claims, 4 Drawing Sheets

(56) References Cited

U.S. PATENT DOCUMENTS

| | | | | |
|---|---|---|---|---|
| 6,959,514 | B1 | 11/2005 | Pingel | |
| 6,983,567 | B2 | 1/2006 | Ciotti | |
| 7,059,488 | B2 * | 6/2006 | Myers | 220/1.5 |
| 7,117,644 | B2 | 10/2006 | Dehart | |
| 7,117,645 | B2 | 10/2006 | Bzorgi | |
| 7,882,973 | B2 * | 2/2011 | Krohn | 220/1.5 |
| 7,984,819 | B1 * | 7/2011 | Davis | 220/4.28 |
| 2005/0044804 | A1 * | 3/2005 | Bin et al. | 52/79.5 |
| 2005/0066590 | A1 | 3/2005 | MacWatt | |
| 2005/0210764 | A1 * | 9/2005 | Foucher et al. | 52/79.5 |
| 2006/0059792 | A1 * | 3/2006 | Tiramani | 52/79.1 |
| 2010/0285269 | A1 * | 11/2010 | Telander | 428/113 |

* cited by examiner

COLLAPSIBLE TEMPORARY HOUSING SYSTEM STACKABLE UPON OTHERS FOR TRANSPORT

CROSS-REFERENCE TO RELATED APPLICATIONS

This application claims the benefit of U.S. Provisional Application No. 61/177,727 filed May 13, 2009, and incorporated herein by reference in its entirety.

BACKGROUND OF THE INVENTION

Exemplary embodiments of the invention generally relate to temporary housing units and, more particularly, to temporary housing units that can withstand severe weather conditions while also being stackable upon each other when collapsed to provide for ease of transportation.

Currently, when a natural disaster strikes, such as an earthquake, flood, tornado, hurricane, etc., houses and other residential dwelling are usually damaged to a point that they are unlivable for a considerable time. Residents are left to seek temporary housing that may be provided by others, such as usually a governmental entity. For example, after Hurricane Katrina made landfall in Louisiana, homes and other residential dwellings were so severely damaged that mobile homes were transported in for use. Whereas, in other natural disasters, tents have also been known to be used. Though mobile homes are more comfortable than tents, transporting mobiles homes requires more transports, trucks, rail vehicles, etc., than required for tents to provide housing for an equal number of displaced individuals since tents may be folded into smaller packages. Another drawback that has been realized with mobile homes is that because of the care and upkeep provided by their temporary residents, the interior of the mobile homes are usually ruined to an extent that the complete mobile home is no longer reusable. Additionally, unused mobile homes may deteriorate in the weather and also be unavailable for further relief efforts.

Though other collapsible temporary housing units are known, such housing units are not easily stackable because when stacked too high, they may lean and fall over, or an equally displaced base is not provided to ensure that pushing a higher stacked unit will not cause it to topple over. Therefore, users and owners of temporary housing units would benefit from a collapsible temporary housing unit that is reusable while also being available for mass transport by providing a minimum transportation size that provides for a level, flat surface to place a plurality of other units on top, without the other units falling over due to gravity.

BRIEF DESCRIPTION OF THE INVENTION

Embodiments of the present invention relate to a collapsible temporary housing system stackable upon another collapsible temporary housing system. The collapsible temporary housing system comprises a rectangular base having four corners, of nearly equal depth, the base is adapted to be located at a desired site and four walls being connected along each respective edge extending between at least two of the four corners, the walls being pivotally connected along the edges of the base so that when the walls are pivoted into a collapsible configuration each wall is laid upon a previously collapsed wall creating a nearly horizontal surface extending all of a top surface area of the base. The collapsible temporary housing system further comprises a flat roof configured to extend beyond the edges of the base, the flat roof being detached from the four walls while the four walls are pivoted into an erected position, secured to the walls once the walls are erected, and is set upon the nearly horizontal surface when the walls are pivoted into a collapsible configuration. The nearly horizontal surface is provided so that when a plurality of housing systems are stacked, each base of a next stacked housing system has each corner at rest upon the horizontal surface on a housing unit immediately below so that a lean of the stacked housing systems which could result in the stacked housing systems falling over is not present.

In another exemplary embodiment, the collapsible temporary housing system comprises a rectangular base having four corners of nearly equal depth, and a first and second wall pivotally connected directly to the base along the shorter edges of the base, opposite each other, and when folded having each top of the first and second wall laying proximate each other creating a first nearly horizontal surface with both of the opposite walls that covers nearly all of the base. The temporary housing system further comprises a third wall, extending along a longer edge of the base, pivotally connected to a first elevated edge separating the third wall from the base so that when folded the third wall collapses on top of and covering the first two walls creating a second nearly horizontal surface, and a fourth wall, extending along a longer edge of the base, pivotally connected to a second edge that is elevated higher than the first edge, separating the fourth wall from the base so that when folded the fourth wall collapses on top of and covering the third wall creating a third nearly horizontal surface. The temporary housing system also comprises a flat roof being detached from the four walls while the four walls are pivoted into an erected position, secured to the walls once the walls are erected, and is set upon the third nearly horizontal surface and covering the third wall when the walls are pivoted into a collapsible configuration. The plurality of nearly horizontal surfaces are provided so that when a plurality of housing systems are stacked, each base of a next stacked housing system has each corner at rest upon the third horizontal surface or the roof of the housing unit immediately below so that a lean of the stacked housing systems which could result in the stacked housing systems falling over is not present.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
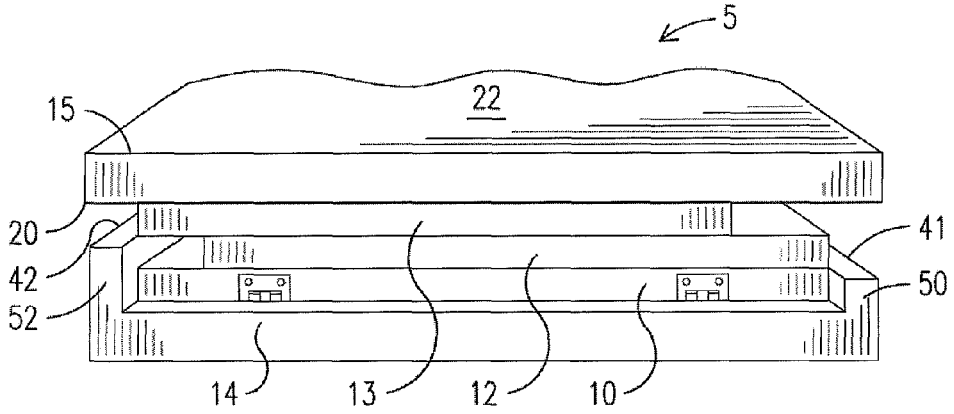
FIG. 1 depicts a perspective view of an exemplary embodiment of the temporary housing system in a collapsed configuration.

Reference will be made below in detail to exemplary embodiments of the invention, examples of which are illustrated in the accompanying drawings. Wherever possible, the same reference numerals used throughout the drawings refer to the same or like parts.

Though exemplary embodiments of the present invention are described with respect to temporary housing, exemplary embodiments of the invention are also applicable for use with other building construction, including permanent housing units, and other structures that may be used for other uses, such as, but not limited to, a manufacturing facility, security post, etc. Thus, exemplary embodiments of the invention solve problems in the art of a structure recognized as a system for providing a readily erectable and collapsible structure where two or fewer individuals are required to erect and/or collapse the structure. Referring now to the drawings, embodiments of the present invention will be described.

FIG. 1 depicts a perspective view of an exemplary embodiment of the temporary housing system in a collapsed configuration. When collapsed each wall 10, 11 (not shown), 12, 13 is positioned to form a nearly horizontal surface above a rectangular base 14 that has four corners of nearly equal depth. The base 14 is adapted to be located at a desired site. Additionally, other than the two shorter walls 10, 11 which do so together (except where there is a gap close to tops of each wall), the other two longer walls 12, 13 cover most of a top surface area of the base 14 of the housing system 5 when collapsed.

Those skilled in the art will readily recognize that "top surface area" refers to the side of the base, wall, or roof, that is last exposed. With respect to the base 14, the top (or exposed) surface area refers to a floor area of the base. For the walls 10, 11, 12, 13, the top (or exposed) surface area pertains to a side of each wall exposed immediately after that particular wall is collapsed. As for the roof 15, the top (or exposed) surface area refers to the side of the roof exposed to natural elements when the housing system 5 is erect. At times herein, surface area is used without "top" or "exposed." Those skilled in the art will recognize that such use of surface area alone is meant to include the use of "top" and/or "exposed."

A flat roof 15 is stacked on top of the collapsed walls 10, 11, 12, 13. Dimensions of the flat roof 15 extend slightly beyond the edges of the base 14 and have a downward facing lip 20, though in another embodiment, the flat roof 15 may have similar dimensions to the base 14. The flat roof 15 is detached from the four walls 10, 11, 12, 13 when in a collapsed configuration. When collapsed, each wall 10, 11, the first wall 10 and the second wall 11 together, provides a nearly horizontal surface that covers nearly the complete top surface area of the upward facing side of the base 14 (as well as the upward facing side of each collapsed wall) so that when another temporary housing system is stacked above the first collapsed temporary housing system 5, all corners of a base 14 of the stacked second temporary housing system 5 rests upon a top horizontal surface 22 of the first temporary housing system 5 so that a lean of the stacked housing systems which could result in the stacked housing systems falling over is not present. In one exemplary embodiment, the base 14 comprises a riser 24 that provides for access beneath the temporary housing system 5 when placed at a site, whereas in another exemplary embodiment the riser 24 is not provided.

Figure 2:
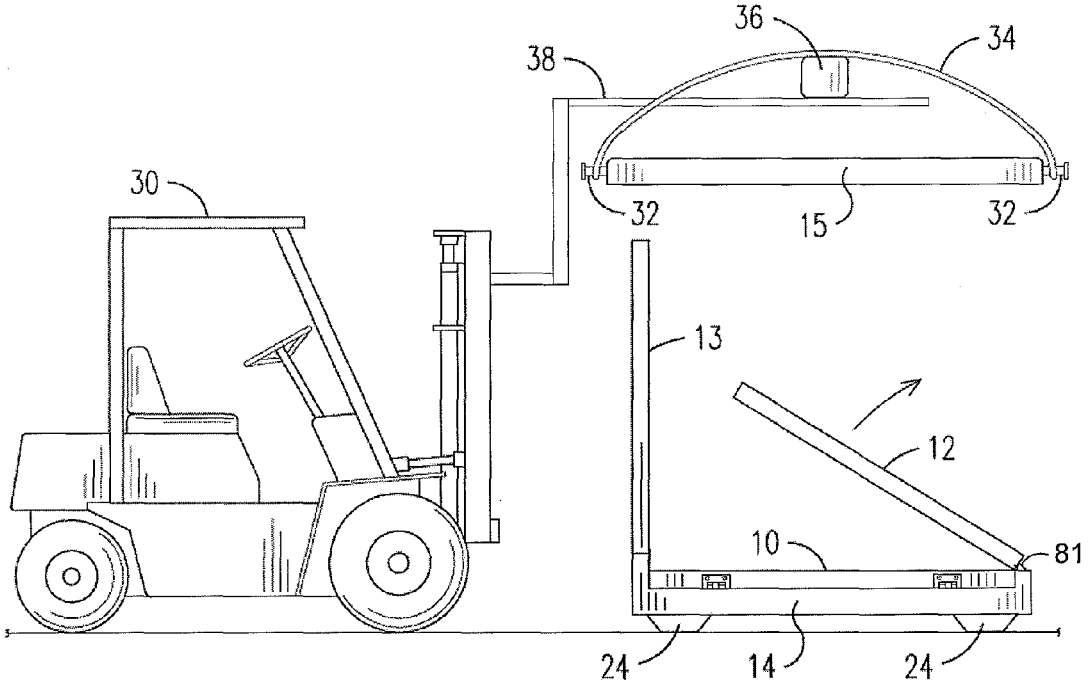
FIG. 2 depicts a perspective view of an exemplary embodiment of the temporary housing system in a semi-erect configuration.
Figure 3:
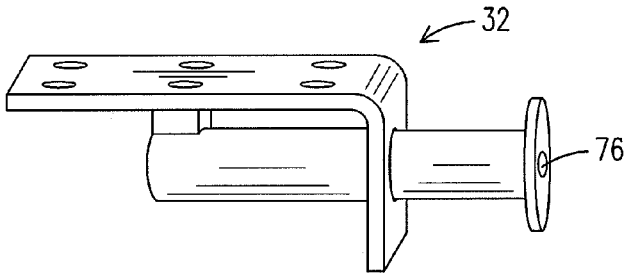
FIG. 3 depicts a perspective view of an exemplary embodiment of a tie-down element and lift element.

FIG. 2 depicts a perspective view of an exemplary embodiment of the temporary housing system in a semi-erect configuration. Once the temporary housing system 5 is placed at the site where it is to be erected, a lifting device 30, such as, but not limited to, a fork lift is used to lift the flat roof 15 from the collapsed house system 5. A plurality of uniform tie-down and lift elements 32, as illustrated in FIG. 3, which are configured to extend from a plurality of locations near the base 14 and on the flat roof 15 are provided to anchor lifting straps 34 to the flat roof 15. A lifting bar 36 may be placed between the lifting straps 34, and forks 38 on the fork lift 30 can lift the flat roof 15 by rising the lifting bar 36. Once the flat roof 15 is held at a sufficient height above a height of the walls 10, 11, 12, 13 (when erected) or away from the walls, a minimum of two to three individuals may lift a first long collapsed wall 13, to an erect position. While holding the first long wall 13 in place, the second long wall 12 is lifted to an erect position. Then either of the short walls 10, 11 are also lifted into an erect position, followed by erecting the other short wall. Each wall 10, 11, 12, 13 is secured, or locked, to an adjacent wall. The flat roof 15 is then lowered onto a top of each wall 10, 11, 12, 13 and is then locked into place.

As explained above, a plurality of uniform tie-down and lift elements 32 are also provided on or near the base 14. They are used to anchor stakes inserted into ground at the site to ensure that the temporary housing system 5 will not move, especially in inclement weather and/or if the temporary housing system 5 is located upon uneven ground. The uniform tie-down and lift elements 32 are extended from the temporary housing system 5 so that the stakes may be attached and when not being used to anchor the housing system in place, may be inserted back into the housing system 5.

Figure 4:
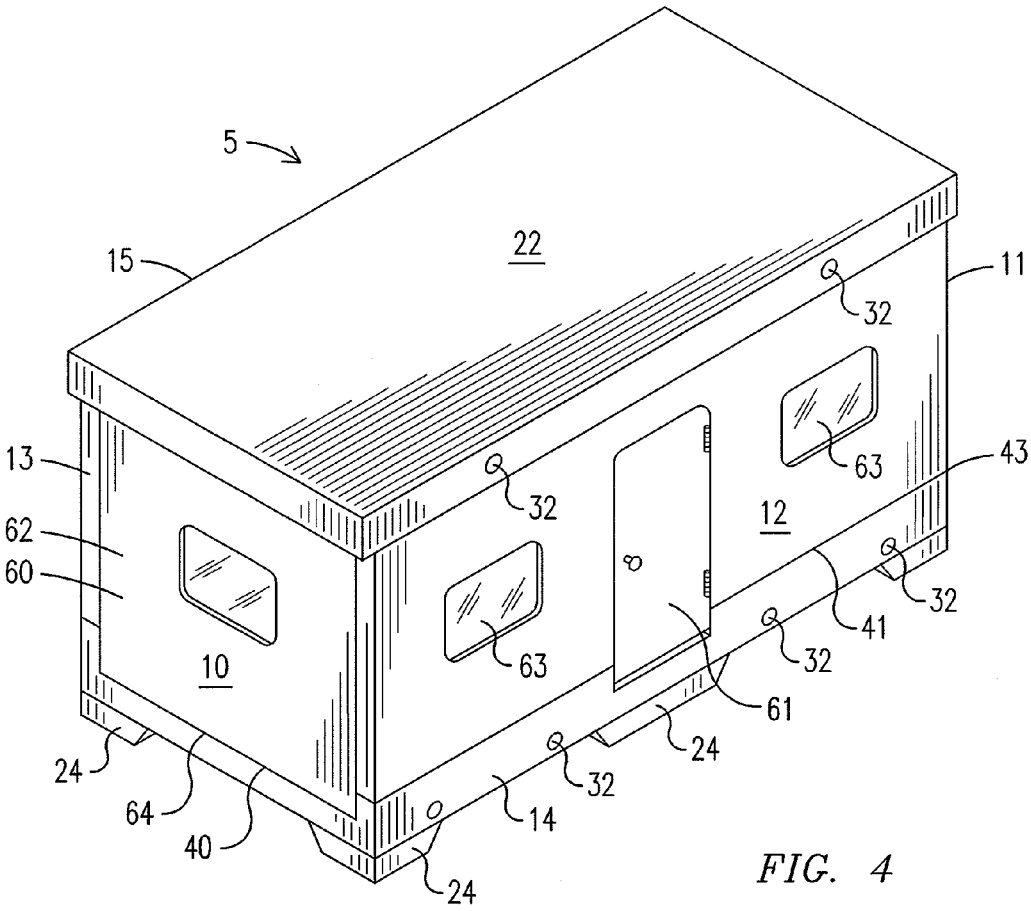
FIG. 4 depicts a perspective view of an exemplary embodiment of an erected temporary housing system.

FIG. 4 depicts a perspective view of an exemplary embodiment of an erected temporary housing system. The four walls 10, 11, 12, 13 are connected along each respective edge 40, 41, 42 (illustrated in FIG. 1), 43 (not shown) of the base 14 where each edge is defined by extending between at least two of the four corners of the base 14. The walls 10, 11, 12, 13 are pivotally connected along the edges 40, 41, 42, 43 of the base 14 so that when the walls 10, 11, 12, 13 are pivoted into a collapsible configuration each wall is laid upon a previously collapsed wall creating a nearly horizontal surface extending over most of the surface area of the exposed base 14, otherwise identified as an upward facing side of the base 14. In an exemplary embodiment a hinging system is used to pivotally connect the walls 10, 11, 12, 13 to the base 14. More specifically, the short walls 10, 11 are pivotally connected directly to the base along the shorter edges 40, 43 of the base 14, opposite each other, and when folded having each top of the first and second wall laying proximate each other creating a first nearly horizontal surface with both of the opposite walls covering nearly all of exposed surface area of the base 14. A first long wall 12 extends along a longer edge of the base 14 and is pivotally connected to a first elevated edge 50 separating the wall 12 from the base 14 so that when folded this wall 12 collapses on top of and covers most of a surface area of the exposed first two walls 10, 11 creating a second nearly horizontal surface. This long wall 12 typically is the wall that has a door entry. The second long wall 13 extends along a second longer edge 42 of the base 14 and is pivotally connected to a second elevated edge 52 that is elevated higher than the first edge 50 to separate this wall 13 from the base 14 so that when folded the fourth wall 13 collapses on top of and covers most, or nearly all, of the surface area of the exposed other long wall 12 creating a third nearly horizontal surface.

As explained above, the flat roof 15 is configured to extend beyond the edges of the base 14. The flat roof 15 is detached from the four walls 10, 11, 12, 13 while the four walls are pivoted into an erected position as well as returned to a collapsible configuration, secured to the walls once the walls are erected, and is set upon the nearly horizontal surface defined by the exposed second long wall 13 when the walls are pivoted into a collapsible configuration. As illustrated, a door 61, or entrance, and at least one window 62 may be preformed in at least one wall 10, 11, 12, 13. The window 62 may be able to open and both the door 61 and window 63 may have a lock provided to secure them.

The elements, flat roof 15, walls 10, 11, 12, 13, and base 14, are made of a laminate material 60. An example of the laminate material 60 includes a lightweight core material sandwiched between a gel coat surfaces on each side of the core material. An attaching material/substance is also applied between the gel coat and the core material. Additionally, another lightweight material, such as, but not limited to, a bi-axle or tri-axle material and/or a chop material is also provided on at least one side of the core material, beneath the gel coat, to provide further structural support to the laminate material. The laminate material 60 may be configured to include an environmentally-specific material 62 unique to an environment where the housing system 5 is utilized. For example, if used in a conflict/combat/war zone, the laminate material 60 may include Kevlar® in its composition. The total weight of the laminate material 60 and hence the temporary housing system 5 depends on a customization of the laminate material 60 for its particular environment. As another example, if the temporary housing system 5 is to be used in a high wind area where debris is blown, the laminate material 60 may be configured to withstand such high winds. When a current use of the temporary housing system 5 is complete, clean up is rather simple, since an inside of the housing system 5 also is covered in the laminate material 60. The housing system 5 may be hosed or washed down, and then returned to storage once dried, ready for its next mission.

A seal member 64 may be located between where adjacent walls meet, each wall is pivotally connected to the base 14, and a top of each wall meets the flat roof 15 when the housing system 5 is erected. The seal member 64 is provided to limit dirt, debris, mildew, moisture, wind, etc., from passing between where the temporary housing system elements meet. Though the seal member 64 may be made of a pliable material, in another exemplary embodiment the seal member comprises a lip that extends from one of the temporary housing elements, and/or a combination of both.

Figure 5:
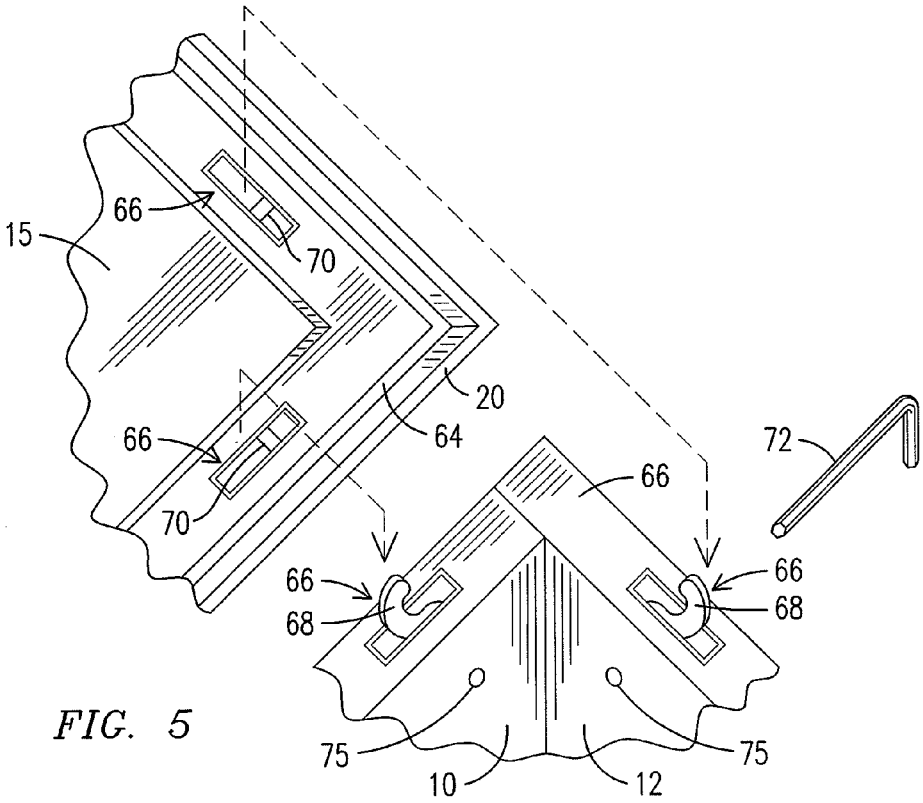
FIG. 5 depicts a perspective view of an exemplary embodiment of a locking subsystem for securing a roof to erected walls of the temporary housing system.

FIG. 5 depicts a perspective view of an exemplary embodiment of a locking subsystem for securing a roof to erected walls. The locking system 66 is used to secure adjacent walls together and the flat roof 15 to a top of each wall. As illustrated, latches 68 are provided that connect to a receiver 70 on either an adjacent wall and/or the flat roof A uniform locking device 72, such as, but not limited to, a hex key, is provided to operate the locking system 66, by being inserted into an opening 75 and rotated. The same uniform locking device 72 may also be used to release the uniform tie-down and lift elements through an opening 76 in the uniform tie-down and lift element so that they may remain fully embedded when not in use and then extended when used.

Figure 6:
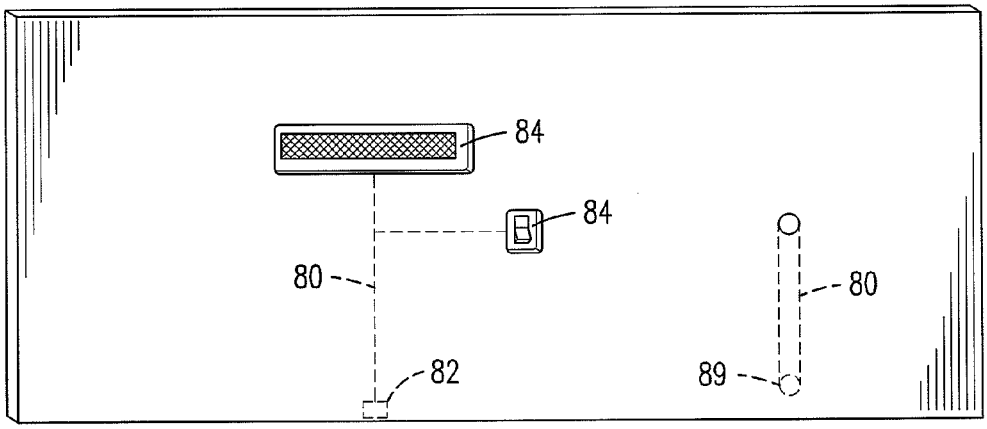
FIG. 6 depicts an inside view of the erected temporary housing system.

FIG. 6 depicts an inside view of the erected temporary housing system. The interior of the temporary housing system may have an internal channel 80 embedded within the walls 10, 11, 12, 13 to provide electricity and/or fluids inside of the housing system when erected. For example, the internal channel 80 may be electrical wires for providing electricity throughout the temporary housing system 5. An electrical connector 82 is provided, such as outside of the housing system 5, so that a generator or other electrical generating system may provide electricity for use in the housing system. Therefore, by being pre-wired, once the housing system is assembled, recessed receptacles 84 providing and/or using electricity are already in place.

In another exemplary embodiment, the internal channel 80 may be a flexible tube, or plumbing line, to provide water inside the housing system or to remove waste from the housing system. A hinged joint connector 81 (as illustrated in FIG. 2) may be provided where the walls meet the base and/or at another location on at lest one wall so that this form of internal channel is not broken when the housing unit collapsed. In another exemplary embodiment, an end 89 of the internal channel exits a wall through a recess that can be covered and/or capped.

As discussed briefly above, at least one recessed fixture 84, connected to, or in communication with, the internal channel 80, is provided within the housing system 5. When the housing system 5 is collapsed, the fixtures 84 are recessed so that they do not alter, or interfere with positioning of the walls 10, 11, 12, 13 and/or the flat roof 15 to create the nearly horizontal surfaces. Exemplary examples of the fixtures 84 include, but are not limited to, lights and light switches. In another exemplary embodiment, the recessed fixtures may be independent of the internal channel 80. For example, recessed furniture, such as a bed or bunk beds, which is folded against a wall into a recess within the housing system, may be provided. In another exemplary embodiment, the furniture is not provided, but attachments for connecting the furniture to the interior wall of the housing unit is provided in a recessed configuration.

Figure 8:
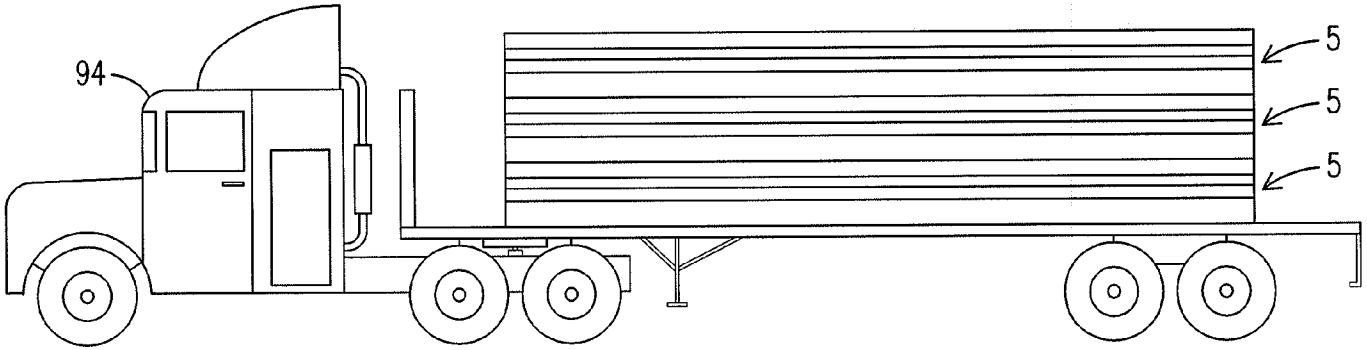
FIG. 8 depicts an exemplary embodiment of a plurality of the temporary housing systems stacked and placed on a flat bed transport vehicle.
Figure 7:
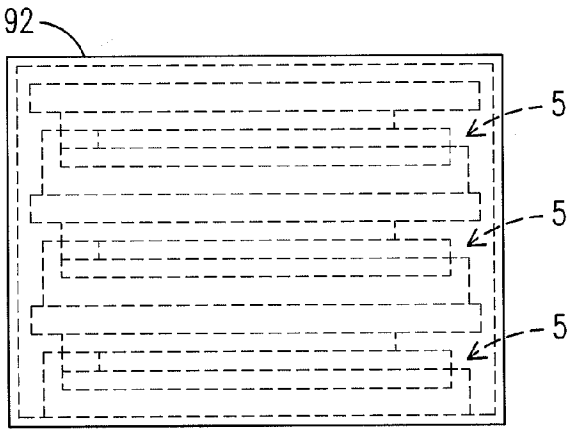
FIG. 7 depicts an exemplary embodiment of a plurality of temporary housing systems stacked and within a cargo container.

FIG. 7 depicts an exemplary embodiment of a plurality of housing systems stacked and within a cargo container, and FIG. 8 depicts an exemplary embodiment of a plurality of housing systems stacked and located upon a flatbed truck and/or rail vehicle for shipping. As illustrated, the width of the housing system 5 is such that the housing system 5 may fit within a standard cargo container 92, which is typically eight feet wide, or on a standard flatbed 94 that is attached to an eighteen-wheel truck and/or is part of a train. The length of the housing system 5 is such that it may fit within the cargo container, which is typically ten feet long, or two housing systems may fit within an elongated cargo container, such as a twenty foot long container. Though those skilled in the art will readily recognize that the container may have a plurality of lengths and widths provided that a transport system and/or storage system is available to accommodate.

Because a nearly level surface is provided by how each housing system is collapsed, multiple temporary housing systems 5 may be stacked on top of each other, as illustrated in FIGS. 7 and 8. Though one exemplary embodiment provides for the top of the collapsible house system 5 being the flat roof 15, in another exemplary embodiment the multiple roofs 15 are stacked independent of the walls 10, 11, 12, 13 and bases 14 (which are hinged together) of multiple housing systems. Thus, when erecting the plurality of house systems, once positioned at a site for erection, the walls of the plurality of housing systems may be erected without requiring a lifting device 30, generally the machine such as a fork lift or crane, to lift the flat roofs. Then once the plurality of housing systems 5 has their walls in place, the lifting device can be used to place the roofs on all of the housing systems.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A collapsible temporary housing system comprising:

a rectangular base having four corners, of nearly equal depth, and edges wherein the base is adapted to be located at a desired site;

four walls being connected along each respective edge extending between at least two of the four corners, each wall being individually pivotally connected along a length of a respective edge of the base so that when the walls are pivoted into a collapsible configuration each wall is laid upon a previously collapsed wall creating a nearly horizontal surface extending over all of a top surface area of the base;

a hinge device having two interlocking elements held together by a pin, the hinge device located and providing a pivotal connection between a respective wall and an edge of the base with the hinge device providing a single rotational degree of freedom around the pin relative to the base, the hinge device is further configured to be embedded out of visual sight within the respective wall, where the wall meets the base, and edge of the base;

a flat roof configured to extend beyond the edges of the base, the flat roof being detached from the four walls while the four walls are pivoted into an erected position, secured to the walls once the walls are erected, and is set upon the nearly horizontal surface when the walls are pivoted into a collapsible configuration;

wherein the nearly horizontal surface is provided so that when a plurality of housing systems are stacked, each base of a next stacked housing system has each corner at rest upon a top horizontal surface of the roof of a housing unit immediately below so that a lean of the stacked housing systems which could result in the stacked housing systems falling over is not present; and a uniform tie-down and lift element comprising a cylindrical portion and an outer flange at an end of the cylindrical portion, wherein a diameter of the outer flange is greater than a diameter of the cylindrical portion, wherein the outer flange is configured to extend from and retract into the base in a direction orthogonal to a surface of an outer perimeter of the base, independent of a corner of the base, and the outer flange is configured to extend from and retract into the flat roof in a direction orthogonal to a surface of an outer perimeter of the flat roof, independent of a corner of the flat roof, wherein the uniform tie-down and lift element further comprises a lock element to lock the element in place when extended and when retracted, wherein the plurality of elements located near the base extend to provide a tie-down anchor for the housing unit and retract when not being used as a tie-down anchor, and the plurality of elements located on the flat roof to extend to provide a lifting anchor for the flat roof and retract when not used to lift the flat roof, and wherein the outer flange is aligned with an outer surface of the base and the flat roof upon retracting into the base and the flat roof.

2. The collapsible temporary housing system according to claim 1, wherein the base, four walls, and flat roof are made of a laminate material comprising a lightweight core material and a gel coat.

3. The collapsible temporary housing system according to claim 2, wherein the laminate material is further configured to comprise a bulletproof material.

4. The collapsible temporary housing system according to claim 1, further comprising a seal member located between where adjacent walls meet, each wall is pivotally connected to the base, and a top of each walls meets the flat roof when the housing system is erected.

5. The collapsible temporary housing system according to claim 1, further comprising a plurality of locking systems wherein a first locking system secures adjacent walls together and a second locking system secures the flat roof to a top of a wall, each locking systems comprises a latch embedded in a wall or the flat roof and a receiver embedded within an abutting wall or flat floor.

6. The collapsible temporary housing system according to claim 5, further comprising a uniform locking device to operate the locking system.

7. The collapsible temporary housing system according to claim 1, further comprising an internal channel embedded within at least one of the walls and the base to provide electricity and/or fluids inside of the housing system when erected wherein the internal channel further comprises a hinged joint connector to provide a continuous connection of the internal channel between the at least one of the walls and the base so that when the at least one of the walls is in a collapsible configuration the internal channel is not broken.

8. The collapsible temporary housing system according to claim 7, further comprising a recessed fixture within the housing system in communication with the internal channel wherein the recessed fixture does not interfere with positioning of the walls and/or roof to create the nearly horizontal surface when the housing system is collapsed.

9. The collapsible temporary housing system according to claim 1, further comprising a window and a door wherein the window and door do not alter the nearly horizontal surface formed when the housing system is collapsed.

10. The collapsible temporary housing system according to claim 1, further comprising a locking system to secure adjacent walls together and the flat roof to a top of each wall, wherein a uniform locking device is provided to operate the locking system and each uniform tie-down and lift element.

11. The collapsible temporary housing system according to claim 1, wherein at least two opposite walls are connected directly to the base and when folded having each top of the at least two opposite walls laying proximate each other creating a nearly horizontal surface with both of the opposite walls, a third wall having a first elevated edge separating the third wall from the base so that when folded the third wall collapses on top of the first two walls creating a nearly horizontal surface, and a fourth wall having a second edge, elevated higher than the first edge, separating the fourth wall from the base so that when folded the fourth wall collapses on top of the third wall creating a nearly horizontal surface.

12. A collapsible temporary housing system comprising:

a rectangular base having four corners of nearly equal depth and shorter edges along a short side of the base and longer edges along a long side of the base;

a first and second wall pivotally connected directly to the base along the shorter edges of the base, opposite each other, and when folded having each top of the first and second wall laying proximate each other creating a first nearly horizontal surface with both of the opposite walls that covers nearly all of a top surface area of the base;

a third wall, extending along a longer edge of the base, pivotally connected to a first elevated edge of the base separating the third wall from the base so that when folded the third wall collapses on top of and covers nearly all of a top surface area of the first two walls creating a second nearly horizontal surface;

a fourth wall, extending along a longer edge of the base, pivotally connected to a second edge that is elevated higher than the first edge, separating the fourth wall from the base so that when folded the fourth wall collapses on top of and covers nearly all of a top surface area of the third wall creating a third nearly horizontal surface;

a flat roof being detached from the four walls while the four walls are pivoted into an erected position, secured to the walls once the walls are erected, and is set upon the third nearly horizontal surface and covering all of a top surface area of the third wall when the walls are pivoted into a collapsible configuration; and a hinge device having two interlocking elements held together by a pin, the hinge device located and providing a pivotal connection between a respective wall and an edge of the base with the hinge device providing a single rotational degree of freedom around the pin relative to the base, the hinge device is further configured to be embedded out of visual sight within the respective wall, where the wall meets the base, and edge of the base;

wherein the plurality of nearly horizontal surfaces are provided so that when a plurality of housing systems are stacked, each base of a next stacked housing system has each corner at rest upon the third horizontal surface or the roof of the housing unit immediately below so that a lean of the stacked housing systems which could result in the stacked housing systems falling over is not present; and a locking system to secure adjacent walls together and the flat roof to a top of each wall, a uniform tie-down and lift element comprising a cylindrical portion and an outer flange at an end of the cylindrical portion, wherein a diameter of the outer flange is greater than a diameter of the cylindrical portion, said outer flange configured to extend from within the base in a direction orthogonal to a surface of an outer perimeter of the base to provide a tie-down anchor for the housing unit and the plurality of elements located on the flat roof such that the outer flange is configured to extend from within the flat roof in a direction orthogonal to a surface of an outer perimeter of the flat roof to provide a lifting anchor for the flat roof, wherein the outer flange is aligned with an outer surface of the base and the flat roof upon retracting into the base and the flat roof and wherein a uniform locking device is provided to operate the locking system and each uniform tie-down and lift element.

13. The collapsible temporary housing system according to claim 12, wherein the base, four walls, and flat roof are made of a laminate material comprising a lightweight core material and a gel coat and wherein the laminate material further comprises a bulletproof material.

14. The collapsible temporary housing system according to claim 12, further comprising a seal member located between where each wall is pivotally connected, between where adjacent wall meets when erected, and at a top of each walls that meets the flat roof when the housing system is erected.

15. The collapsible temporary housing system according to claim 12, further comprising internal channel embedded within at least one of the walls and the base to provide electricity and/or fluids inside of the housing system when erected wherein the internal channel further comprises a hinged joint connector to provide a continuous connection of the internal channel between the at least one of the walls and the base so that when the at least one of the walls is in a collapsible configuration the internal channel is not broken.

16. The collapsible temporary housing system according to claim 15, further comprising a recessed fixture within the housing system in communication with the internal channel wherein the recessed fixtures does not interfere with positioning of the walls and/or roof to create the nearly horizontal surfaces when the housing system is collapsed.

17. A collapsible temporary housing system comprising:

a rectangular base having four corners, of nearly equal depth, and edges wherein the base is adapted to be located at a desired site;

four walls being connected along each respective edge extending between at least two of the four corners, each wall being individually pivotally connected along a length of a respective edge of the base so that when the walls are pivoted into a collapsible configuration each wall is laid upon a previously collapsed wall creating a nearly horizontal surface extending over all of a top surface area of the base;

a hinge device having two interlocking elements held together by a pin, the hinge device located and providing a pivotal connection between a respective wall and an edge of the base with the hinge device providing a single rotational degree of freedom around the pin relative to the base, the hinge device is further configured to be embedded out of visual sight within the respective wall, where the wall meets the base, and edge of the base;

a uniform tie-down and lift element comprising a cylindrical portion and an outer flange at an end of the cylindrical portion, wherein a diameter of the outer flange is greater than a diameter of the cylindrical portion, wherein the outer flange is configured to extend from and retract into the base, in a direction orthogonal to a surface of an outer perimeter of the base, independent of a corner of the base, and said outer flange configured to extend from and retract to within the flat roof, in a direction orthogonal to a surface of an outer perimeter of the roof, independent of a corner of the flat roof, wherein the uniform tie-down and lift element further comprises a lock element to lock the element in place when extended and when retracted, and wherein the plurality of elements located near the base extend from the base to provide a tie-down anchor for the housing unit and retract into the base when not being used as a tie-down anchor, and the plurality of elements located on the flat roof to extend from the roof to provide a lifting anchor for the flat roof and retract into the roof when not used to lift the flat roof, and wherein the outer flange is aligned with an outer surface of the base and the flat roof upon retracting into the base and the flat roof;

a flat roof configured to extend beyond the edges of the base, the flat roof being detached from the four walls while the four walls are pivoted into an erected position, secured to the walls once the walls are erected, and is set upon the nearly horizontal surface when the walls are pivoted into a collapsible configuration; and a plurality of locking systems with a first locking system to secure adjacent walls together and a second locking system to secure the flat roof to a top of a wall, each locking systems further comprises a latch embedded in a wall or the flat roof and a receiver embedded within an abutting wall or the flat floor;

wherein the nearly horizontal surface is provided so that when a plurality of housing systems are stacked, each base of a next stacked housing system has each corner at rest upon a top horizontal surface of the roof of a housing unit immediately below so that a lean of the stacked housing systems which could result in the stacked housing systems falling over is not present.

18. The collapsible temporary housing system according to claim 17, further comprising a uniform locking device to release the lock element of the uniform tie-down and lift element before the uniform tie-down and lift element is extended or retracted and to secure the lock element to prevent movement of the uniform tie-down after the uniform tie-down and lift element is extended or retracted, and to operate the locking system to secure adjacent walls together and the flat roof to a top of each wall and to release adjacent walls from the flat roof before collapsing the walls.

* * * * *